US005393200A

United States Patent [19]

Dinh et al.

[11] Patent Number: 5,393,200

[45] Date of Patent: Feb. 28, 1995

[54] BUCKET FOR THE LAST STAGE OF TURBINE

[75] Inventors: Cuong V. Dinh, Schenectady; Stephen G. Ruggles, Scotia; James H. Vogan, Schenectady, all of N.Y.

[73] Assignee: General Electric Co., Schenectady, N.Y.

[21] Appl. No.: 222,786

[22] Filed: Apr. 4, 1994

[51] Int. Cl.[6] ..... F01D 5/12; F01D 5/22

[52] U.S. Cl. ..... 416/223 A; 416/191; 416/DIG. 2

[58] Field of Search ..... 416/191, 190, 196 R, 416/223 A, DIG. 2

[56] References Cited

U.S. PATENT DOCUMENTS 5,267,834 12/1993 Dinh et al. ..... 416/223 A 5,286,169 2/1994 Dinh et al. ..... 416/223 A

*Primary Examiner*—Edward K. Look

*Assistant Examiner*—Michael S. Lee

*Attorney, Agent, or Firm*—Nixon & Vanderhye

[57] ABSTRACT

A last-stage steam turbine bucket having a profile according to the charts set forth in the specification.

9 Claims, 6 Drawing Sheets

FIG. 3
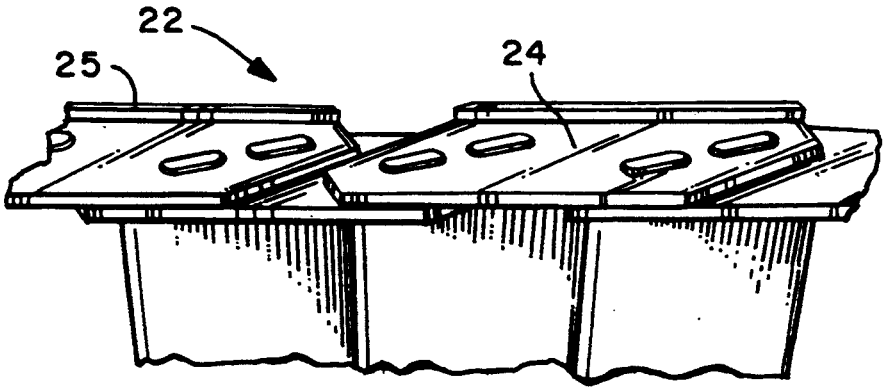
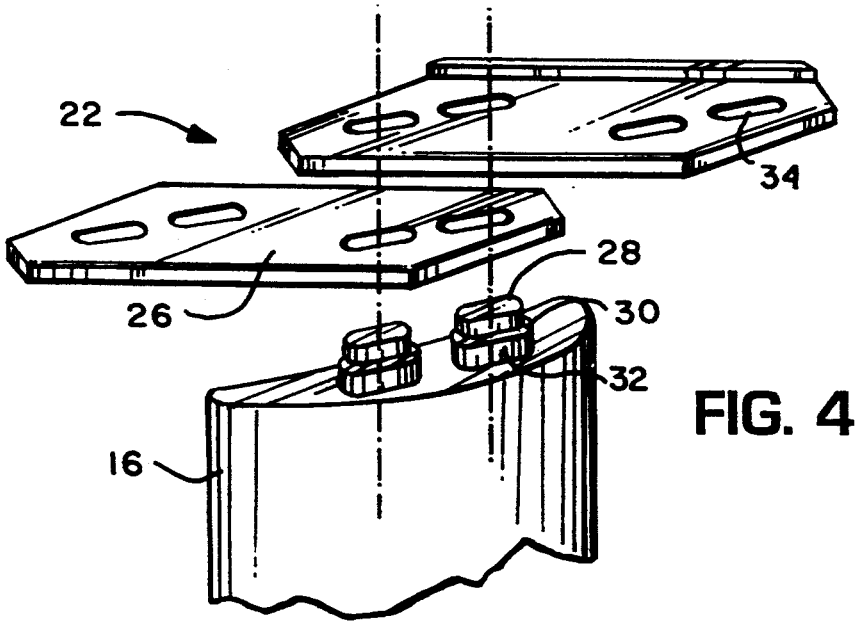
FIG. 4

BUCKET FOR THE LAST STAGE OF TURBINE

TECHNICAL FIELD

The present invention relates to turbines, particularly steam turbines, and particularly relates to last-stage steam turbine buckets having improved aerodynamic, thermodynamic and mechanical properties.

BACKGROUND

Last-stage buckets for turbines have for some time been the subject of substantial developmental work. It is highly desirable to optimize the performance of these last-stage buckets to reduce aerodynamic losses and to improve the thermodynamic performance of the turbine. Last-stage buckets are exposed to a wide range of flows, loads and strong dynamic forces. Factors which affect the final bucket profile design include the active length of the bucket, the pitch diameter and the high operating speed in both supersonic and subsonic flow regions. Damping and bucket fatigue are factors which must also be considered in the mechanical design of the bucket and its profile. These mechanical and dynamic response properties of the buckets, as well as others, such as aero-thermodynamic properties or material selection, all influence the optimum bucket profile. The last-stage steam turbine buckets require, therefore, a precisely defined bucket profile for optimal performance with minimal losses over a wide operating range.

Adjacent rotor buckets are typically connected together by some form of cover bands or shroud bands around the periphery to confine the working fluid within a well-defined path and to increase the rigidity of the buckets. Grouped buckets, however, can be stimulated by a number of stimuli known to exist in the working fluid to vibrate at the natural frequencies of the bucket-cover assembly. If the vibration is sufficiently large, fatigue damage to the bucket material can occur and lead to crack initiation and eventual failure of the bucket components. Also, last-stage buckets operate in a wet steam environment and are subject to potential erosion by water droplets. A method of erosion protection normally used is to either weld or braze a protective shield to the leading edge of each bucket at its upper active length. These shields, however, may be subject to stress corrosion cracking or departure from the buckets due to deterioration of the bonding material as in the case of a brazed shield.

DISCLOSURE OF THE INVENTION

In accordance with the present invention, there is provided a bucket profile design for the last-stage bucket of a turbine, preferably a steam turbine, which affords significantly enhanced aerodynamic and thermodynamic efficiency, and mechanical reliability, while providing for (1) transonic convergent/divergent supersonic flow passages; (2) bucket overtwist to account for bucket untwist at operational speed to optimize efficiency; (3) a radial cover sealing rib to minimize tip leakage losses; (4) improved blade incidence loss; (5) reduced section edge thickness; (6) improved stage root reaction; (7) optimized flow distribution; (8) a continuously coupled over-under cover design for structural coupling and damping to minimize vibration; (9) loose tie wire connection at mid-bucket for added structural damping; and (10) a flame-hardened section leading edge for protection against water droplet impact erosion.

In a preferred embodiment according to the present invention, there is provided a bucket for a steam turbine having a profile in accordance with Charts 2–12, 14–22 and 24, inclusive, as set forth in the specification.

Accordingly, it is a primary object of the present invention to provide a novel and improved bucket for the last stage of a steam turbine having a profile affording improved aerodynamic and thermodynamic performance, and mechanical reliability.

BRIEF DESCRIPTION OF THE DRAWINGS

FIG. 3 is a perspective view of the assembled over-under cover construction for the bucket tips;

FIG. 4 is an exploded perspective view of the over-under covers and the bucket tip end to which the covers are assembled;

BEST MODE FOR CARRYING OUT THE INVENTION

Figure 2:
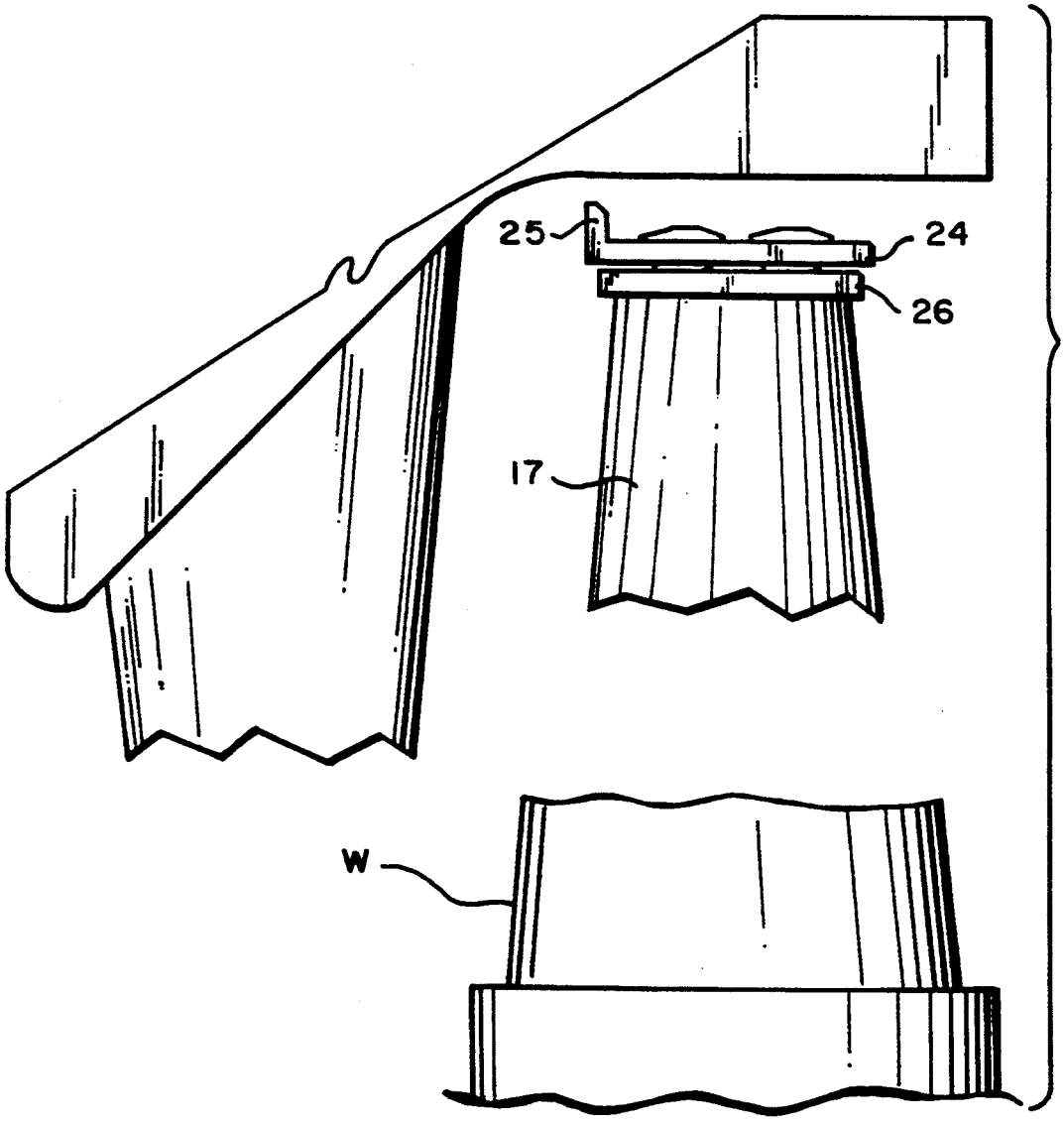
FIG. 2 is an enlarged fragmentary elevational view illustrating a bucket tip and cover assembly for tip leakage control.
Figure 5:
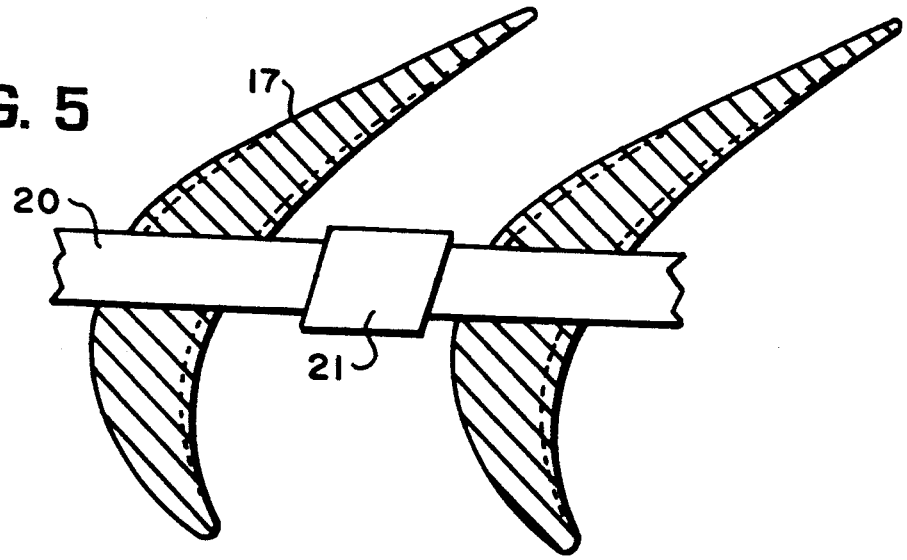
FIG. 5 is an enlarged cross-sectional view of connections between a pair of adjacent buckets at their mid-point illustrating the connection by the tie wire between the buckets.
Figure 6:
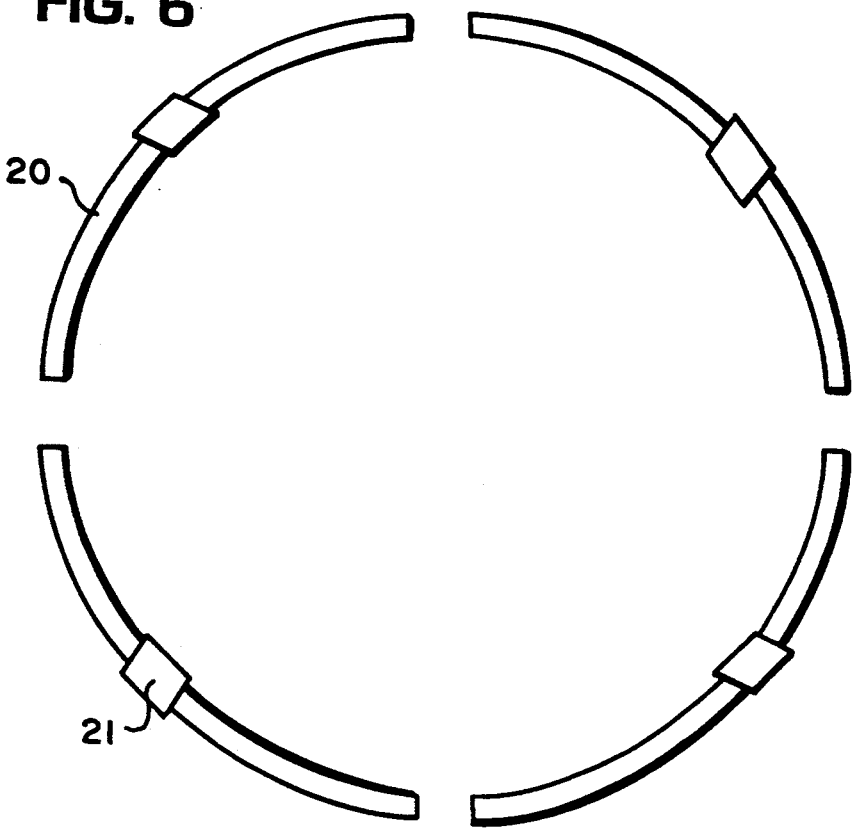
FIG. 6 is a front elevational view of the tie wire.
Figure 7:
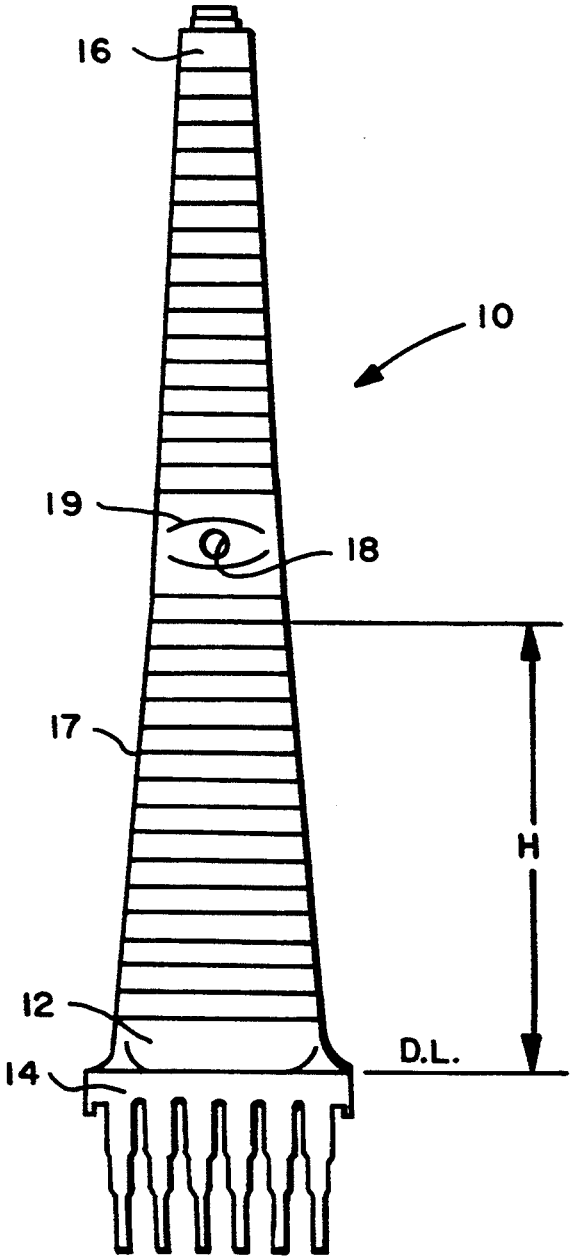
FIG. 7 is a tangential view of a last-stage bucket constructed in accordance with the present invention and illustrating its theoretical aerodynamic profile.

Referring now to the drawings particularly to FIG. 7, there is illustrated a bucket of the present invention, generally designated 10, having a root section 12 connected to a finger dovetail section 14 for connection to the rotor wheel W (FIG. 2) of the turbine. Bucket 10 also includes a tip 16 to which covers are applied, as described hereafter. Adjacent the mid-point of the airfoil section 17 of each bucket, there is provided a central opening 18 through a built-up section of the bucket for receiving a tie wire 20. The openings 18 and wires 20 form a loose connection at the mid-bucket section, with a specified clearance therebetween. The mid-bucket section is also built up at 19 for receiving the tie wire 20 to reduce the centrifugal stress in that mid-bucket region. As illustrated in FIG. 6, the tie wires 20 are provided in four circular arcs, each connecting a 90° arc segment of the bucketed wheel. On assembly of the wires in the bucket, the mid-section of the wires has a sleeve 21 so that the wires do not back out of the bucket opening during turbine rotation. Alternatively, and in lieu of a mid-span sleeve, a pair of sleeves may be provided at opposite ends of each tie wire to maintain the wires coupled to the buckets. The loose coupling between the tie wire and the buckets is provided to dampen the bucket vibration.

Referring now to FIGS. 3 and 4, there is illustrated a continuous over-under cover arrangement for the tip portions of the turbine buckets. Particularly, the cover, generally designated 22, includes an outer cover 24 and an inner cover 26. As illustrated, each tip 16 of the bucket includes a pair of radially outwardly projecting tenons 28 each having a step 30. The inner cover 26 spans adjacent turbine buckets and has openings generally complementary to, larger than, and loosely overlying the lower portions 32 of the tenons. The inner cover spans a pair of adjacent turbine buckets. The inner cover is therefore loosely mounted on adjacent buckets. Each outer cover 24 likewise spans a pair of adjacent turbine buckets. The pairs of turbine buckets spanned by the inner and outer covers alternate with one another with the outer cover overlying the adjacent ends of adjacent inner covers. The outer cover 24 includes openings 34 for receiving the outer portions of the tenons and rests on the steps 30 of the tenons 28. The inner and outer covers thus overlap one another at the tenons. The outer cover extends to an adjacent bucket and is rigidly connected to the top of each tenon step. On assembly, the top of each tenon is peened over the outer cover to provide the necessary rigid connection between adjacent pairs of buckets and the outer cover. A sealing rib 25 is formed on the upstream side of the outer cover 24 to minimize tip leakage losses. Thus, while the buckets of discrete adjacent pairs of buckets are rigidly connected to the outer cover 24, adjacent pairs are movable relative to each other because of the loose connection between the inner cover 26 and the bucket tenons 28.

Figure 1:
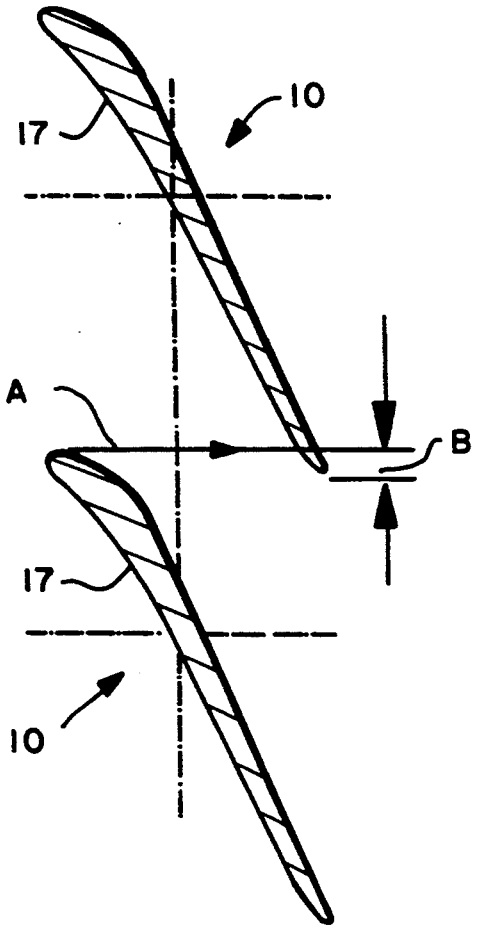
FIG. 1 is a schematic illustration of the bucket tips of adjacent buckets illustrating the converging-diverging supersonic flow passage.

Referring to FIG. 1, a pair of adjacent bucket tips are illustrated in profile with A designating the axis of rotation of the turbine buckets. Note the transonic convergent/divergent supersonic flow path between the leading and trailing edges of the adjacent buckets. Additionally, note the blade overlap designated B affording high solidity. This vane overlap reduces flow losses. Additionally, the leading edges of the buckets are flame-hardened to prevent erosion from impact of steam.

Figure 8:
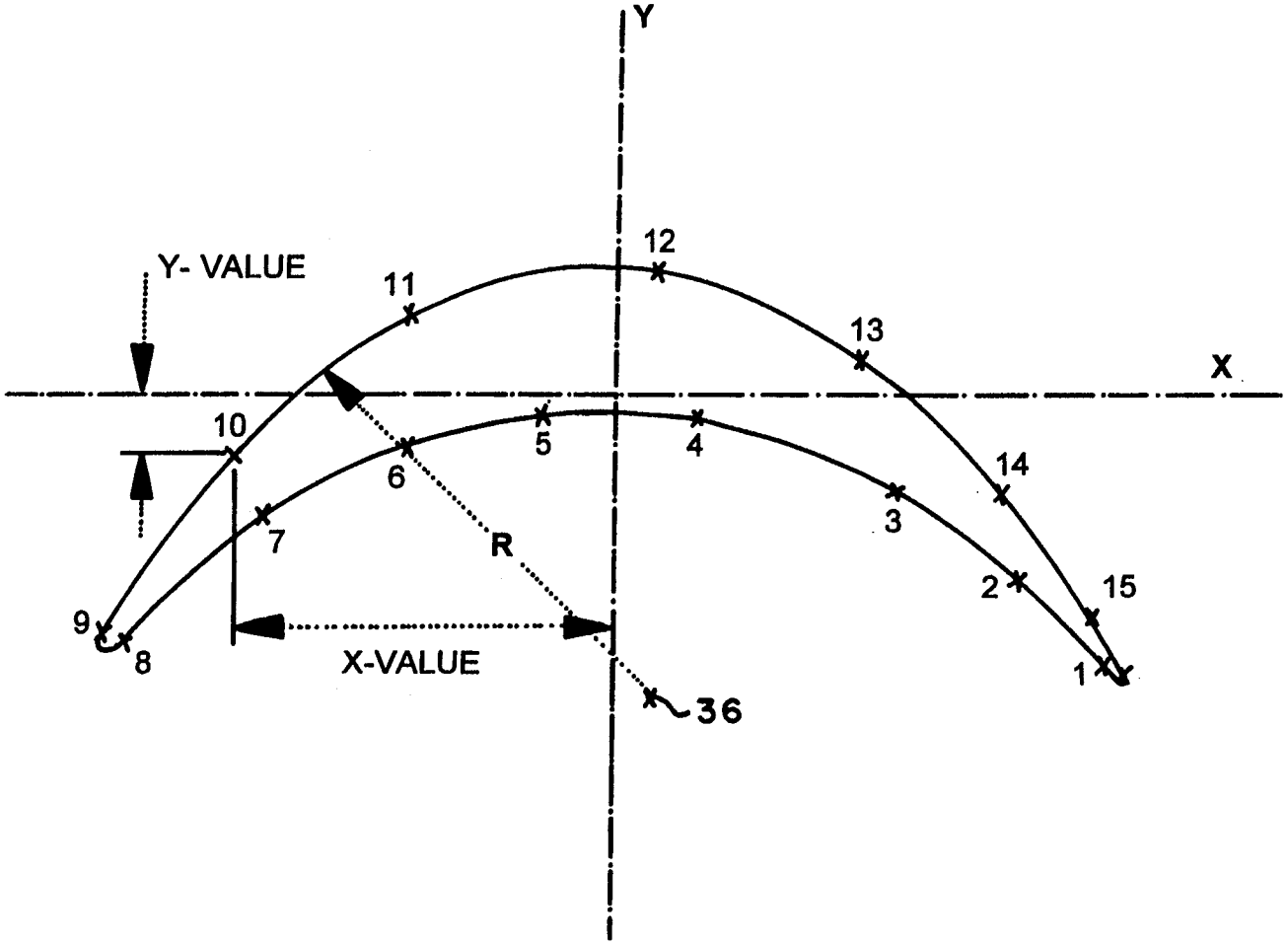
FIG. 8 is a graph illustrating a representative airfoil section of the bucket profile as defined by the charts set forth in the following specification.

Referring now to FIG. 8, there is illustrated a representative bucket section profile at a predetermined radial distance H (a representative height H being illustrated in FIG. 7) from a datum line D. L. at the intersection of the bucket root and dovetail sections 12 and 14, respectively, as illustrated in FIG. 7. Each profile section at that radial distance is defined in X–Y coordinates by adjacent points identified by representative numerals, for example, the illustrated numerals 1 through 15, and which adjacent points are connected one to the other along the arcs of circles having radii R. Thus, the arc connecting points 10 and 11 constitutes a portion of a circle having a radius R at a center 36 as illustrated. Values of the X–Y coordinates and the radii R for each bucket section profile taken at specific radial locations or heights H from the datum line D. L. are tabulated in the following charts numbered 1 through 24. The charts identify the various points along a profile section at the given radial distance H from the datum line D. L. by their X–Y coordinates and it will be seen that the charts have anywhere from 17 to 31 representative X–Y coordinate points, depending upon the profile section height from the datum line. These values are given in inches and represent actual bucket configurations at ambient, non-operating conditions (with the exception of the coordinate points noted below for the theoretical blade profiles at the root, mid-point and tip of the bucket). The value for each radius R provides the length of the radius defining the arc of the circle between two of the adjacent points identified by the X–Y coordinates. The sign convention assigns a positive value to the radius R when the adjacent two points are connected in a clockwise direction and a negative value to the radius R when the two adjacent points are connected in a counterclockwise direction. By providing X–Y coordinates for spaced points about the blade profile at selected radial positions or heights H from the datum line and defining the radii R of circles connecting adjacent points, the profile of the bucket is defined at each radial position and thus the bucket profile is defined throughout its entire length. Chart 1 represents the theoretical profile of the bucket at the datum line. The actual profile at that location includes the fillets in the root section 12 connecting the airfoil and dovetail sections, the fillets fairing the profiled bucket into the structural base of the bucket. The actual profile of the bucket at the datum line D. L. is not given but the theoretical profile of the bucket at the datum line is given in Chart 1.

From a review of Charts Nos. 13 and 14, it will be appreciated that there are two sets of X–Y coordinates and radii R for the bucket profile at the radial distance H of 25.8 inches from the root section. Chart 14 provides the X–Y coordinates and radii R of the actual bucket profile as thickened or built-up with bucket material from the desired theoretical aerodynamic profile at that distance from the datum line. Chart 13 at the same profile section 25.8 inches from the datum line provides the desired theoretical aerodynamic profile at that radial location and without the build-up necessary for the central opening 18. Similarly, the tips of the buckets are built-up for mechanical strength reasons and to provide support for the tip covers. Accordingly, Chart 24 provides X–Y coordinates and radii R for the actual bucket profile at the tip as built-up. The theoretically desirable aerodynamic profile is provided by Chart 23 at a slightly different radial distance from the datum line.

It will be appreciated that having defined the profile of the bucket at various selected heights from the root, properties of the bucket such as the maximum and minimum moments of inertia, the area of the bucket at each section, the twist, torsional stiffness, shear centers and vane width can be ascertained.

Accordingly, Charts 2–12, 14–22 and 24 identify the actual profile of a bucket; Charts 1, 13 and 25 identify the theoretical profiles of a bucket at the designated locations therealong.

Also, in the preferred embodiment, the turbine includes 130 buckets, each of the profile provided by the Charts 2–12, 14–22 and 24 and having the theoretical profile given by the X, Y, and R values at the radial distances of Charts 1, 13 and 23.

CHART NO. 1
RADIAL DISTANCE FROM DATUM 0.

| POINT NO. | X | Y | R |
|---|---|---|---|
| 1 | −4.41069 | −1.85325 | 0.05320 |
| 2 | −4.49154 | −1.80304 | 0.27858 |
| 3 | −4.46547 | −1.70847 | 6.93671 |
| 4 | −4.00022 | −0.88496 | 4.21858 |
| 5 | −3.43675 | −0.19928 | 4.07220 |
| 6 | −1.69709 | 0.81893 | 5.54547 |
| 7 | −0.58470 | 1.01588 | 7.30091 |
| 8 | 0.71136 | 0.99555 | 4.93733 |
| 9 | 2.47908 | 0.46295 | 3.84707 |
| 10 | 3.73166 | −0.57959 | 4.75699 |
| 11 | 4.10566 | −1.13480 | 9.93173 |
| 12 | 4.53642 | −1.97251 | 0.04860 |
| 13 | 4.45365 | −2.02224 | −4.51055 |
| 14 | 2.90253 | −0.73876 | −6.12264 |
| 15 | 0.64406 | −0.10532 | −8.86745 |
| 16 | −1.02007 | −0.12741 | −5.16274 |

-continued

CHART NO. 1
RADIAL DISTANCE FROM DATUM 0.

| POINT NO. | X | Y | R |
|---|---|---|---|
| 17 | −2.25636 | −0.41761 | −5.75010 |
| 18 | −3.47012 | −1.03825 | −4.71659 |
| 19 | −4.34938 | −1.80210 | 0.27858 |
| 20 | −4.41069 | −1.85325 | 0. |

CHART NO. 2
RADIAL DISTANCE FROM DATUM 2.150

| POINT NO. | X | Y | R |
|---|---|---|---|
| 1 | −4.15296 | −1.72952 | 0.06228 |
| 2 | −4.24667 | −1.66897 | 0.32054 |
| 3 | −4.22277 | −1.57874 | 0.85754 |
| 4 | −4.19945 | −1.52883 | 6.91569 |
| 5 | −3.73640 | −0.74754 | 5.39686 |
| 6 | −3.47880 | −0.40203 | 3.83183 |
| 7 | −1.94272 | 0.73690 | 3.94143 |
| 8 | −1.32052 | 0.93144 | 4.92035 |
| 9 | −0.65061 | 1.03359 | 5.51922 |
| 10 | −0.53429 | 1.04196 | 5.61366 |
| 11 | 0.78379 | 0.96729 | 4.54423 |
| 12 | 2.35660 | 0.37446 | 4.26934 |
| 13 | 3.62620 | −0.81157 | 5.69375 |
| 14 | 3.94735 | −1.32209 | 11.51244 |
| 15 | 4.33749 | −2.08784 | 0.04632 |
| 16 | 4.25834 | −2.13503 | −4.82433 |
| 17 | 2.77399 | −0.82540 | −5.86575 |
| 18 | 0.76044 | −0.12749 | −6.66486 |
| 19 | −0.76327 | −0.07209 | −5.92259 |
| 20 | −1.21683 | −0.12533 | −4.78050 |
| 21 | −2.30363 | −0.43052 | −5.01808 |
| 22 | −3.96676 | −1.55212 | −5.14408 |
| 23 | −4.06286 | −1.65268 | 0.84454 |
| 24 | −4.09399 | −1.68444 | 0.31992 |
| 25 | −4.15296 | −1.72952 | 0. |

CHART NO. 3
RADIAL DISTANCE FROM DATUM 4.300

| POINT NO. | X | Y | R |
|---|---|---|---|
| 1 | −3.90556 | −1.60178 | 0.07082 |
| 2 | −4.01071 | −1.53113 | 0.37082 |
| 3 | −3.97117 | −1.40594 | 7.31216 |
| 4 | −3.28379 | −0.33580 | 3.55992 |
| 5 | −2.59984 | 0.33749 | 3.60583 |
| 6 | −1.05032 | 1.00405 | 4.55977 |
| 7 | 0.84504 | 0.92940 | 4.26527 |
| 8 | 2.30375 | 0.24456 | 4.75494 |
| 9 | 3.47829 | −0.98647 | 7.01245 |
| 10 | 3.77571 | −1.48170 | 13.46135 |
| 11 | 4.13880 | −2.19677 | 0.04421 |
| 12 | 4.06302 | −2.24158 | −5.19080 |
| 13 | 2.56694 | −0.86083 | −5.75092 |
| 14 | 0.56181 | −0.10486 | −5.30451 |
| 15 | −1.22860 | −0.09848 | −4.33569 |
| 16 | −2.74703 | −0.65927 | −4.67837 |
| 17 | −3.40701 | −1.13935 | −5.98433 |
| 18 | −3.81936 | −1.53439 | 0.37082 |
| 19 | −3.90556 | −1.60178 | 0. |

CHART NO. 4
RADIAL DISTANCE FROM DATUM 6.450

| POINT NO. | X | Y | R |
|---|---|---|---|
| 1 | −3.67579 | −1.46627 | 0.07806 |
| 2 | −3.79038 | −1.38653 | 0.40685 |
| 3 | −3.74200 | −1.24477 | 8.26694 |
| 4 | −3.11145 | −0.26846 | 3.42492 |
| 5 | −2.40151 | 0.43465 | 3.31272 |
| 6 | −0.89241 | 1.04436 | 3.88383 |
| 7 | 0.58073 | 0.96864 | 4.07219 |

-continued

CHART NO. 4
RADIAL DISTANCE FROM DATUM 6.450

| POINT NO. | X | Y | R |
|---|---|---|---|
| 8 | 2.02094 | 0.28486 | 4.95428 |
| 9 | 2.62336 | −0.24422 | 5.24955 |
| 10 | 3.15839 | −0.89373 | 6.07313 |
| 11 | 3.43770 | −1.33386 | 11.73376 |
| 12 | 3.72617 | −1.86176 | 15.14798 |
| 13 | 3.94093 | −2.29380 | 0.04240 |
| 14 | 3.86807 | −2.33657 | −5.53432 |
| 15 | 2.57965 | −1.03994 | −5.80908 |
| 16 | 0.74206 | −0.16533 | −4.51409 |
| 17 | 0.17543 | −0.04612 | −4.50340 |
| 18 | −1.08165 | −0.04350 | −3.88088 |
| 19 | −2.61035 | −0.59207 | −4.50143 |
| 20 | −3.15898 | −0.99571 | −6.55778 |
| 21 | −3.55135 | −1.36452 | 7.70633 |
| 22 | −3.58002 | −1.39367 | 0.40214 |
| 23 | −3.67579 | −1.46627 | 0. |

CHART NO. 5
RADIAL DISTANCE FROM DATUM 8.600

| POINT NO. | X | Y | R |
|---|---|---|---|
| 1 | −3.46164 | −1.32421 | 0.08384 |
| 2 | −3.58329 | −1.23652 | 0.43897 |
| 3 | −3.53099 | −1.08884 | 9.40938 |
| 4 | −2.95561 | −0.20278 | 3.30498 |
| 5 | −2.45854 | 0.33786 | 3.03777 |
| 6 | −0.98182 | 1.03951 | 3.35826 |
| 7 | 0.73059 | 0.88891 | 3.85951 |
| 8 | 1.83212 | 0.27151 | 5.45588 |
| 9 | 2.86380 | −0.81925 | 6.65327 |
| 10 | 3.23650 | −1.40405 | 16.66649 |
| 11 | 3.74583 | −2.37687 | 0.04090 |
| 12 | 3.67537 | −2.41795 | −5.90313 |
| 13 | 0.63288 | −0.16305 | −3.92340 |
| 14 | −1.07863 | −0.01070 | −3.47690 |
| 15 | −2.58861 | −0.59073 | −4.41286 |
| 16 | −3.05491 | −0.95932 | −7.99945 |
| 17 | −3.35412 | −1.24495 | 0.43897 |
| 18 | −3.46164 | −1.32421 | 0. |

CHART NO. 6
RADIAL DISTANCE FROM DATUM 10.750

| POINT NO. | X | Y | R |
|---|---|---|---|
| 1 | −3.25888 | −1.17735 | 0.08866 |
| 2 | −3.38586 | −1.08229 | 0.46348 |
| 3 | −3.32787 | −0.92751 | 10.28641 |
| 4 | −2.76606 | −0.08305 | 3.01275 |
| 5 | −2.39800 | 0.32967 | 2.82078 |
| 6 | −0.92846 | 1.05085 | 2.93232 |
| 7 | 0.51656 | 0.92319 | 3.55678 |
| 8 | 1.62783 | 0.28845 | 4.48811 |
| 9 | 1.74604 | 0.18533 | 6.16272 |
| 10 | 2.79142 | −1.04405 | 6.88226 |
| 11 | 2.86904 | −1.16709 | 8.82480 |
| 12 | 3.08282 | −1.53346 | 19.82031 |
| 13 | 3.55556 | −2.44539 | 0.03977 |
| 14 | 3.48693 | −2.48519 | −6.42572 |
| 15 | 2.19662 | −1.09152 | −6.07391 |
| 16 | 2.15945 | −1.06196 | −5.85413 |
| 17 | 0.61355 | −0.18625 | −3.56148 |
| 18 | −0.44431 | 0.03990 | −3.47720 |
| 19 | −0.96279 | 0.03135 | −3.12990 |
| 20 | −2.45479 | −0.50889 | −4.00675 |
| 21 | −2.86183 | −0.83034 | −8.74790 |
| 22 | −3.11926 | −1.07181 | 2.46422 |
| 23 | −3.14924 | −1.10060 | 0.46004 |
| 24 | −3.25888 | −1.17735 | 0. |

CHART NO. 7
RADIAL DISTANCE FROM DATUM 12.900

| POINT NO. | X | Y | R |
|---|---|---|---|
| 1 | −3.06759 | −1.02404 | 0.09212 |
| 2 | −3.19840 | −0.92381 | 0.48233 |
| 3 | −3.13486 | −0.76111 | 10.30556 |
| 4 | −2.58812 | 0.03595 | 2.79109 |
| 5 | −2.18696 | 0.46364 | 2.61084 |
| 6 | 0.57496 | 0.85601 | 3.44711 |
| 7 | 1.58785 | 0.17246 | 6.84199 |
| 8 | 2.66071 | −1.17391 | 11.03372 |
| 9 | 2.96170 | −1.70059 | 24.18248 |
| 10 | 3.37043 | −2.49899 | 0.03936 |
| 11 | 3.30243 | −2.53829 | −7.11696 |
| 12 | 2.02327 | −1.10513 | −5.71183 |
| 13 | 0.56111 | −0.19754 | −3.25381 |
| 14 | −0.97757 | 0.05448 | −2.79946 |
| 15 | −2.34060 | −0.42901 | −3.60333 |
| 16 | −2.70470 | −0.71538 | −9.25959 |
| 17 | −2.94441 | −0.93800 | 0.48233 |
| 18 | −3.06759 | −1.02404 | 0. |

CHART NO. 8
RADIAL DISTANCE FROM DATUM 15.050

| POINT NO. | X | Y | R |
|---|---|---|---|
| 1 | −2.88837 | −0.86272 | 0.09419 |
| 2 | −3.02240 | −0.76061 | 0.49240 |
| 3 | −2.95830 | −0.59478 | 7.76314 |
| 4 | −2.82774 | −0.39453 | 8.75502 |
| 5 | −2.42511 | 0.15702 | 2.65300 |
| 6 | −2.01589 | 0.56737 | 2.37814 |
| 7 | −0.01945 | 1.02357 | 2.37741 |
| 8 | 0.46425 | 0.85791 | 3.06558 |
| 9 | 1.07266 | 0.48160 | 4.19808 |
| 10 | 1.57340 | 0.01816 | 6.69411 |
| 11 | 2.26642 | −0.86902 | 10.17737 |
| 12 | 2.60540 | −1.42217 | 14.27556 |
| 13 | 2.94589 | −2.05331 | 37.91108 |
| 14 | 3.19009 | −2.53874 | 0.03970 |
| 15 | 3.12152 | −2.57844 | −7.96108 |
| 16 | 3.11048 | −2.56203 | −7.89372 |
| 17 | 2.11325 | −1.35721 | −6.56738 |
| 18 | 1.35433 | −0.71215 | −5.21863 |
| 19 | 0.65214 | −0.27935 | −3.71471 |
| 20 | 0.34224 | −0.13566 | −3.03461 |
| 21 | −0.48504 | 0.06738 | −3.04294 |
| 22 | −1.11049 | 0.06763 | −2.43957 |
| 23 | −2.05448 | −0.22917 | −2.84735 |
| 24 | −2.47652 | −0.51882 | −5.82965 |
| 25 | −2.75285 | −0.76516 | 0.49954 |
| 26 | −2.88837 | −0.86272 | 0. |

CHART NO. 9
RADIAL DISTANCE FROM DATUM 17.200

| POINT NO. | X | Y | R |
|---|---|---|---|
| 1 | −2.72186 | −0.69654 | 0.09615 |
| 2 | −2.85909 | −0.59284 | 0.50345 |
| 3 | −2.78574 | −0.40961 | 6.97802 |
| 4 | −2.31704 | 0.22685 | 2.60663 |
| 5 | −1.87777 | 0.64651 | 2.15711 |
| 6 | 0.44619 | 0.81635 | 2.90485 |
| 7 | 0.99643 | 0.43070 | 5.66914 |
| 8 | 1.64359 | −0.24924 | 6.44545 |
| 9 | 2.09299 | −0.88201 | 15.49142 |
| 10 | 2.68926 | −1.92709 | 11.45257 |
| 11 | 2.74131 | −2.02839 | 75.91293 |
| 12 | 3.01270 | −2.56838 | 0.03960 |
| 13 | 2.94430 | −2.60800 | −8.94657 |
| 14 | 2.11321 | −1.54540 | −7.49178 |
| 15 | 1.20921 | −0.70475 | −4.81598 |
| 16 | 0.46807 | −0.22466 | −2.92246 |
| 17 | −0.17450 | 0.02091 | −2.98953 |
| 18 | −1.11244 | 0.10454 | −2.10457 |
| 19 | −1.87635 | −0.09709 | −2.42931 |

-continued

CHART NO. 9
RADIAL DISTANCE FROM DATUM 17.200

| POINT NO. | X | Y | R |
|---|---|---|---|
| 20 | −2.34049 | −0.38799 | −4.42739 |
| 21 | −2.60189 | −0.61350 | 0.50345 |
| 22 | −2.72186 | −0.69654 | 0. |

CHART NO. 10
RADIAL DISTANCE FROM DATUM 19.350

| POINT NO. | X | Y | R |
|---|---|---|---|
| 1 | −2.56831 | −0.52906 | 0.09877 |
| 2 | −2.70793 | −0.42077 | 0.51380 |
| 3 | −2.63216 | −0.23689 | 2.88467 |
| 4 | −2.59749 | −0.18582 | 5.29739 |
| 5 | −2.19215 | 0.32708 | 2.49350 |
| 6 | −1.67463 | 0.76630 | 2.04073 |
| 7 | −1.55243 | 0.83830 | 1.95348 |
| 8 | 0.17211 | 0.90753 | 2.08844 |
| 9 | 0.56051 | 0.68251 | 3.72525 |
| 10 | 0.99186 | 0.31240 | 6.11983 |
| 11 | 1.71277 | −0.55583 | 6.84547 |
| 12 | 1.86473 | −0.78757 | 10.86680 |
| 13 | 2.05104 | −1.09588 | 17.15725 |
| 14 | 2.52192 | −1.96136 | 53.40278 |
| 15 | 2.72904 | −2.37397 | 0. |
| 16 | 2.83748 | −2.59234 | 0.03801 |
| 17 | 2.77177 | −2.63027 | −9.51446 |
| 18 | 2.62001 | −2.40859 | −10.58613 |
| 19 | 1.78196 | −1.36721 | −7.31336 |
| 20 | 1.30900 | −0.89529 | −6.24875 |
| 21 | 0.99423 | −0.62718 | −4.69792 |
| 22 | 0.53589 | −0.30495 | −3.53118 |
| 23 | 0.10294 | −0.07747 | −2.76506 |
| 24 | −0.77053 | 0.14622 | −2.66063 |
| 25 | −1.10510 | 0.15424 | −1.82860 |
| 26 | −1.72120 | 0.02156 | −2.15772 |
| 27 | −2.18226 | −0.23508 | −3.61108 |
| 28 | −2.44276 | −0.44434 | 1.15176 |
| 29 | −2.45602 | −0.45586 | 0.51643 |
| 30 | −2.56831 | −0.52906 | 0. |

CHART NO. 11
RADIAL DISTANCE FROM DATUM 21.500

| POINT NO. | X | Y | R |
|---|---|---|---|
| 1 | −2.42400 | −0.36008 | 0.10005 |
| 2 | −2.56181 | −0.24589 | 0.52385 |
| 3 | −2.47514 | −0.05626 | 4.28912 |
| 4 | −2.03993 | 0.45301 | 2.36079 |
| 5 | −1.53813 | 0.83559 | 1.77124 |
| 6 | 0.13527 | 0.88747 | 2.12844 |
| 7 | 0.60386 | 0.56598 | 5.49198 |
| 8 | 1.22765 | −0.10044 | 6.35707 |
| 9 | 1.62834 | −0.66831 | 12.86738 |
| 10 | 2.12082 | −1.52575 | 26.73739 |
| 11 | 2.34362 | −1.96025 | 132.22974 |
| 12 | 2.66854 | −2.61295 | 0.03600 |
| 13 | 2.60636 | −2.64895 | −13.37123 |
| 14 | 1.59969 | −1.33093 | −6.41287 |
| 15 | 0.77258 | −0.53401 | −4.27928 |
| 16 | 0.11060 | −0.09624 | −2.62111 |
| 17 | −0.46791 | 0.12991 | −2.39336 |
| 18 | −1.08323 | 0.20658 | −1.64352 |
| 19 | −1.59028 | 0.12325 | −1.92278 |
| 20 | −2.04762 | −0.09909 | −3.43972 |
| 21 | −2.30654 | −0.28858 | 0.52385 |
| 22 | −2.42400 | −0.36008 | 0. |

CHART NO. 12
RADIAL DISTANCE FROM DATUM 23.650

| POINT NO. | X | Y | R |
|---|---|---|---|
| 1 | −2.28510 | −0.18818 | 0.09814 |
| 2 | −2.41426 | −0.06899 | 0.51270 |
| 3 | −2.32350 | 0.10639 | 3.68252 |
| 4 | −1.87091 | 0.58199 | 2.82581 |
| 5 | −1.65463 | 0.75405 | 1.79098 |
| 6 | −1.40865 | 0.90243 | 1.61610 |
| 7 | −0.32677 | 1.03145 | 1.60141 |
| 8 | −0.28572 | 1.02148 | 1.61780 |
| 9 | 0.26104 | 0.76452 | 2.78706 |
| 10 | 0.63423 | 0.43984 | 5.67556 |
| 11 | 1.16291 | −0.19689 | 6.63590 |
| 12 | 1.35974 | −0.48866 | 10.25556 |
| 13 | 1.49790 | −0.71193 | 14.13712 |
| 14 | 1.91860 | −1.46245 | 32.21285 |
| 15 | 2.13981 | −1.89480 | 0. |
| 16 | 2.51003 | −2.63203 | 0.03456 |
| 17 | 2.45078 | −2.66729 | −27.71436 |
| 18 | 2.30936 | −2.46616 | 2.43578 |
| 19 | 2.27018 | −2.40925 | −4.06156 |
| 20 | 2.23994 | −2.36463 | −14.29706 |
| 21 | 1.47144 | −1.34690 | −6.86074 |
| 22 | 0.73818 | −0.58821 | −5.61060 |
| 23 | 0.42002 | −0.32630 | −3.97827 |
| 24 | 0.17298 | −0.15216 | −2.77647 |
| 25 | −0.33408 | 0.10748 | −2.18013 |
| 26 | −1.00801 | 0.25233 | −1.71258 |
| 27 | −1.28546 | 0.24452 | −1.63536 |
| 28 | −1.87063 | 0.05891 | −2.96606 |
| 29 | −2.15832 | −0.11867 | 12.76221 |
| 30 | −2.17301 | −0.12892 | 0.51956 |
| 31 | −2.28510 | −0.18818 | 0. |

CHART NO. 13
RADIAL DISTANCE FROM DATUM 25.800

| POINT NO. | X | Y | R |
|---|---|---|---|
| 1 | −2.15183 | −0.01263 | 0.09417 |
| 2 | −2.26676 | 0.11055 | 0.49309 |
| 3 | −2.17299 | 0.26634 | 3.41018 |
| 4 | −1.51601 | 0.83740 | 1.40513 |
| 5 | −0.89402 | 1.06425 | 1.54304 |
| 6 | −0.48699 | 1.05594 | 1.42685 |
| 7 | −0.11188 | 0.94387 | 1.61200 |
| 8 | 0.31181 | 0.66241 | 4.26333 |
| 9 | 0.86274 | 0.04531 | 6.90482 |
| 10 | 1.21224 | −0.48142 | 17.70037 |
| 11 | 1.70762 | −1.36401 | 0. |
| 12 | 2.36184 | −2.64952 | 0.03335 |
| 13 | 2.30518 | −2.68431 | 0. |
| 14 | 2.16144 | −2.48750 | 1.00000 |
| 15 | 2.13043 | −2.44249 | −13.50000 |
| 16 | 1.29333 | −1.29167 | −7.87966 |
| 17 | 0.38430 | −0.34478 | −3.00057 |
| 18 | −0.29009 | 0.10387 | −2.04541 |
| 19 | −1.05542 | 0.30499 | −1.49493 |
| 20 | 1.72263 | 0.19325 | −2.69929 |
| 21 | −2.01659 | 0.04949 | −3.12706 |
| 22 | −2.04407 | 0.03375 | 0.49309 |
| 23 | −2.15183 | −0.01263 | 0. |

CHART NO. 14
RADIAL DISTANCE FROM DATUM 25.8"
(Build-up Section)

| POINT NO. | X | Y | R |
|---|---|---|---|
| 1 | −2.13656 | −0.00663 | 0.09417 |
| 2 | −2.26677 | 0.11053 | 0.49309 |
| 3 | −2.17299 | 0.26634 | 3.41018 |
| 4 | −1.51601 | 0.83740 | 1.40513 |
| 5 | −1.15723 | 1.00877 | 1.67500 |
| 6 | 0.56859 | 0.55274 | 3.75000 |
| 7 | 1.16812 | −0.30392 | 0. |
| 8 | 2.36185 | −2.64952 | 0.03335 |

-continued

CHART NO. 14
RADIAL DISTANCE FROM DATUM 25.8"
(Build-up Section)

| POINT NO. | X | Y | R |
|---|---|---|---|
| 9 | 2.30566 | −2.68495 | 0. |
| 10 | 1.55578 | −1.70751 | −7.87966 |
| 11 | 0.30559 | −0.41504 | −3.00600 |
| 12 | −0.53636 | 0.07276 | −2.00000 |
| 13 | −2.13656 | −0.00663 | 0.0 |

CHART NO. 15
RADIAL DISTANCE FROM DATUM 27.950

| POINT NO. | X | Y | R |
|---|---|---|---|
| 1 | −2.02367 | 0.16661 | 0.09049 |
| 2 | −2.12205 | 0.29426 | 0.48045 |
| 3 | −2.02499 | 0.43102 | 3.14960 |
| 4 | −1.55895 | 0.80997 | 3.05948 |
| 5 | −1.42636 | 0.89339 | 1.53979 |
| 6 | −1.38564 | 0.91674 | 1.30093 |
| 7 | −0.89534 | 1.07193 | 1.39873 |
| 8 | −0.76487 | 1.07987 | 1.35375 |
| 9 | −0.03812 | 0.88030 | 1.66486 |
| 10 | 0.28373 | 0.62314 | 3.28940 |
| 11 | 0.36657 | 0.53498 | 4.74820 |
| 12 | 0.86884 | −0.12832 | 9.78999 |
| 13 | 1.10195 | −0.51976 | 27.02881 |
| 14 | 1.64259 | −1.52677 | 0. |
| 15 | 2.22292 | −2.66482 | 0.03157 |
| 16 | 2.16957 | −2.69813 | 0. |
| 17 | 2.03519 | −2.51950 | 1.79714 |
| 18 | 1.94109 | −2.38151 | −3.92130 |
| 19 | 1.91117 | −2.33370 | −13.37530 |
| 20 | 1.20955 | −1.33417 | −11.37308 |
| 21 | 0.93806 | −0.99622 | −9.05112 |
| 22 | 0.36373 | −0.37069 | −3.07400 |
| 23 | −0.14224 | 0.03469 | −2.69940 |
| 24 | −0.39725 | 0.17918 | −1.89243 |
| 25 | −0.96225 | 0.35648 | −1.55704 |
| 26 | −1.21448 | 0.37308 | −1.53214 |
| 27 | −1.57184 | 0.32174 | −2.38214 |
| 28 | −1.90666 | 0.20508 | 3.24449 |
| 29 | −1.93167 | 0.19434 | 0.44330 |
| 30 | −2.02367 | 0.16661 | 0. |

CHART NO. 16
RADIAL DISTANCE FROM DATUM 30.100

| POINT NO. | X | Y | R |
|---|---|---|---|
| 1 | −1.89297 | 0.34689 | 0.09140 |
| 2 | −1.97983 | 0.48542 | 0.47860 |
| 3 | −1.88406 | 0.59853 | 2.12032 |
| 4 | −1.73032 | 0.71953 | 3.04772 |
| 5 | −1.33861 | 0.95713 | 1.26465 |
| 6 | 0.01508 | 0.81836 | 1.81524 |
| 7 | 0.28864 | 0.55227 | 4.72885 |
| 8 | 0.65090 | 0.05410 | 7.39822 |
| 9 | 0.91186 | −0.39270 | 58.93269 |
| 10 | 1.58781 | −1.68721 | −92.40452 |
| 11 | 1.79218 | −2.08827 | 0. |
| 12 | 2.09348 | −2.67604 | 0.02894 |
| 13 | 2.04468 | −2.70672 | 0. |
| 14 | 1.87866 | −2.48786 | 1.00000 |
| 15 | 1.81962 | −2.40088 | −14.62303 |
| 16 | 0.73079 | −0.83937 | −8.30797 |
| 17 | 0.29379 | −0.33527 | −3.21102 |
| 18 | −0.35817 | 0.19732 | −1.73700 |
| 19 | −0.93447 | 0.42372 | −1.47923 |
| 20 | −1.25638 | 0.45137 | −2.00165 |
| 21 | −1.62963 | 0.40721 | −2.92823 |
| 22 | −1.80911 | 0.36264 | 0.47860 |
| 23 | −1.89297 | 0.34689 | 0. |

CHART NO. 17
RADIAL DISTANCE FROM DATUM 32.250

| POINT NO. | X | Y | R |
|---|---|---|---|
| 1 | −1.75760 | 0.52420 | 0.09880 |
| 2 | −1.83774 | 0.68570 | 0.45249 |
| 3 | −1.78258 | 0.74193 | 0.89794 |
| 4 | −1.69045 | 0.81107 | 1.72082 |
| 5 | −1.58538 | 0.87461 | 2.39232 |
| 6 | −1.21431 | 1.04168 | 1.27382 |
| 7 | −0.70478 | 1.11073 | 1.18210 |
| 8 | −0.43088 | 1.05898 | 1.12309 |
| 9 | −0.07429 | 0.87090 | 1.65684 |
| 10 | 0.12554 | 0.68542 | 2.30556 |
| 11 | 0.32243 | 0.43769 | 5.45205 |
| 12 | 0.53281 | 0.10724 | 8.86098 |
| 13 | 0.70464 | −0.19909 | 11.66712 |
| 14 | 0.81176 | −0.40412 | 0. |
| 15 | 1.97307 | −2.68161 | 0.02570 |
| 16 | 1.92961 | −2.70869 | 0. |
| 17 | 1.76463 | −2.48853 | 1.63068 |
| 18 | 1.65773 | −2.32662 | −4.65053 |
| 19 | 1.62591 | −2.27241 | −17.91615 |
| 20 | 0.72911 | −0.91255 | −9.23040 |
| 21 | 0.27999 | −0.34308 | −4.00888 |
| 22 | −0.24131 | 0.16522 | −1.97620 |
| 23 | −0.37488 | 0.26461 | −1.64634 |
| 24 | −0.74833 | 0.45432 | −1.64508 |
| 25 | −1.07448 | 0.53174 | −2.17291 |
| 26 | −1.46123 | 0.54793 | −3.33205 |
| 27 | −1.68435 | 0.52983 | 0.97177 |
| 28 | −1.75760 | 0.52420 | 0. |

CHART NO. 18
DISTANCE FROM DATUM 34.400

| POINT NO. | X | Y | R |
|---|---|---|---|
| 1 | −1.63647 | 0.69759 | 0.10285 |
| 2 | −1.69658 | 0.87980 | 0.44459 |
| 3 | −1.66593 | 0.90279 | 1.03634 |
| 4 | −1.47425 | 1.00662 | 1.95104 |
| 5 | −1.11064 | 1.11634 | 1.37121 |
| 6 | −0.63891 | 1.12704 | 1.07460 |
| 7 | −0.24595 | 0.98545 | 1.05664 |
| 8 | −0.03038 | 0.81391 | 2.25607 |
| 9 | 0.22229 | 0.50054 | 3.68082 |
| 10 | 0.41313 | 0.18121 | 22.80914 |
| 11 | 0.83071 | −0.64531 | −40.12734 |
| 12 | 1.01645 | −1.02708 | −43.11551 |
| 13 | 1.26068 | −1.51457 | 0. |
| 14 | 1.85579 | −2.68397 | 0.02276 |
| 15 | 1.81715 | −2.70774 | 0. |
| 16 | 1.60853 | −2.42315 | 1.00000 |
| 17 | 1.54658 | −2.32769 | −23.27576 |
| 18 | 0.72970 | −1.00179 | −11.10185 |
| 19 | 0.28893 | −0.38415 | −5.59099 |
| 20 | −0.18826 | 0.16119 | −1.79588 |
| 21 | −0.50953 | 0.41703 | −1.44474 |
| 22 | −0.80351 | 0.55722 | −2.32948 |
| 23 | −1.20492 | 0.65677 | −3.21203 |
| 24 | −1.42483 | 0.68323 | −6.05169 |
| 25 | −1.63647 | 0.69759 | 0. |

CHART NO. 19
RADIAL DISTANCE FROM DATUM 36.550

| POINT NO. | X | Y | R |
|---|---|---|---|
| 1 | −1.53925 | 0.87180 | 0.09710 |
| 2 | −1.56389 | 1.05437 | 0.71955 |
| 3 | −1.53482 | 1.06783 | 1.31300 |
| 4 | −1.32819 | 1.13820 | 1.62994 |
| 5 | −0.89483 | 1.18643 | 1.37720 |
| 6 | −0.65760 | 1.16021 | 1.06682 |
| 7 | −0.38061 | 1.06387 | 1.06758 |
| 8 | −0.06165 | 0.80942 | 1.84297 |
| 9 | 0.01223 | 0.71675 | 2.85651 |
| 10 | 0.21981 | 0.39563 | 5.87076 |

-continued

CHART NO. 19
RADIAL DISTANCE FROM DATUM 36.550

| POINT NO. | X | Y | R |
|---|---|---|---|
| 11 | 0.38824 | 0.06854 | 32.00337 |
| 12 | 0.42794 | −0.01518 | −22.05536 |
| 13 | 0.55624 | −0.28213 | 65.63972 |
| 14 | 0.78127 | −0.74704 | −61.60846 |
| 15 | 1.17353 | −1.55066 | 0. |
| 16 | 1.73745 | −2.68496 | 0.02118 |
| 17 | 1.70134 | −2.70682 | −97.75568 |
| 18 | 1.49428 | −2.42237 | 1.48825 |
| 19 | 1.41493 | −2.30193 | 2.30143 |
| 20 | 1.37558 | −2.23270 | −7.59316 |
| 21 | 1.34727 | −2.18128 | −28.79194 |
| 22 | 0.71854 | −1.10543 | −18.83818 |
| 23 | 0.37903 | −0.57255 | −9.72511 |
| 24 | 0.24340 | −0.37279 | −7.38149 |
| 25 | −0.14092 | 0.13087 | −2.25227 |
| 26 | −0.38641 | 0.38259 | −1.54857 |
| 27 | −0.71071 | 0.60122 | −2.44438 |
| 28 | −1.03951 | 0.73779 | −4.50797 |
| 29 | −1.46392 | 0.85611 | −2.17983 |
| 30 | −1.53925 | 0.87180 | 0. |

CHART NO. 20
RADIAL DISTANCE FROM DATUM 38.700

| POINT NO. | X | Y | R |
|---|---|---|---|
| 1 | −1.44818 | 1.06577 | 0.09020 |
| 2 | −1.43430 | 1.23736 | 1.54175 |
| 3 | −0.63077 | 1.20433 | 0.99294 |
| 4 | −0.25644 | 0.98777 | 1.23182 |
| 5 | −0.06476 | 0.76327 | 3.72642 |
| 6 | 0.18929 | 0.31711 | 17.26597 |
| 7 | 0.37528 | −0.08217 | −17.26597 |
| 8 | 0.46500 | −0.27811 | 0. |
| 9 | 1.62487 | −2.68239 | 0.02087 |
| 10 | 1.58916 | −2.70369 | 0. |
| 11 | 1.35161 | −2.37512 | 1.25000 |
| 12 | 1.26207 | −2.23181 | −39.17161 |
| 13 | 0.28173 | −0.50391 | −8.90852 |
| 14 | −0.11054 | 0.09282 | −3.18689 |
| 15 | −0.37489 | 0.41505 | −1.73941 |
| 16 | −0.60441 | 0.62031 | −2.50048 |
| 17 | −0.95048 | 0.83695 | −5.87234 |
| 18 | −1.44818 | 1.06577 | 0. |

CHART NO. 21
RADIAL DISTANCE FROM DATUM 40.850

| POINT NO. | X | Y | R |
|---|---|---|---|
| 1 | −1.34751 | 1.29370 | 0.08979 |
| 2 | −1.29657 | 1.45398 | 0.92778 |
| 3 | −1.10521 | 1.44382 | 1.66369 |
| 4 | −0.73738 | 1.34143 | 1.38885 |
| 5 | −0.57632 | 1.26343 | 1.09504 |
| 6 | −0.24226 | 0.97062 | 1.98412 |
| 7 | −0.08799 | 0.73275 | 6.16142 |
| 8 | 0.12505 | 0.30842 | 64.61592 |
| 9 | 0.13577 | 0.28484 | 0. |
| 10 | 0.34346 | −0.17241 | −15.65653 |
| 11 | 0.44551 | −0.39253 | 0. |
| 12 | 1.52480 | −2.67411 | 0.02144 |
| 13 | 1.48800 | −2.69579 | 0. |
| 14 | 1.24401 | −2.35601 | 1.62059 |
| 15 | 1.14580 | −2.20152 | 3.43291 |
| 16 | 1.09989 | −2.11662 | −76.74968 |
| 17 | 0.21494 | −0.47256 | −45.92421 |
| 18 | 0.14164 | −0.34079 | −5.52305 |
| 19 | −0.12990 | 0.11198 | −4.64079 |
| 20 | −0.36430 | 0.44382 | −3.10364 |
| 21 | −0.48524 | 0.59054 | −3.05503 |
| 22 | −0.89984 | 0.97612 | −5.31819 |
| 23 | −1.25031 | 1.22421 | 1.32388 |

-continued

CHART NO. 21
RADIAL DISTANCE FROM DATUM 40.850

| POINT NO. | X | Y | R |
|---|---|---|---|
| 24 | −1.34751 | 1.29370 | 0. |

CHART NO. 22
RADIAL DISTANCE FROM DATUM 42.750

| POINT NO. | X | Y | R |
|---|---|---|---|
| 1 | −1.25344 | 1.51487 | 0.09442 |
| 2 | −1.16990 | 1.66295 | 0.52958 |
| 3 | −0.98245 | 1.61568 | 2.26182 |
| 4 | −0.70898 | 1.46645 | 1.32336 |
| 5 | −0.26490 | 0.99453 | 4.35448 |
| 6 | −0.19434 | 0.86240 | 8.42088 |
| 7 | 0.02281 | 0.40492 | −17.11133 |
| 8 | 0.17426 | 0.06931 | 0. |
| 9 | 1.44309 | −2.66380 | 0.02238 |
| 10 | 1.40454 | −2.68621 | 0. |
| 11 | 1.13028 | −2.30079 | 1.60933 |
| 12 | 1.01008 | −2.10323 | 0. |
| 13 | 0.04763 | −0.23017 | −7.16654 |
| 14 | −0.53606 | 0.71685 | −7.05272 |
| 15 | −0.57147 | 0.76497 | −4.26319 |
| 16 | −1.16826 | 1.41881 | 0.54320 |
| 17 | −1.25344 | 1.51487 | 0. |

CHART NO. 23
RADIAL DISTANCE FROM DATUM 43.000

| POINT NO. | X | Y | R |
|---|---|---|---|
| 1 | −1.24098 | 1.54462 | 0.09538 |
| 2 | −1.15312 | 1.69088 | 0.49943 |
| 3 | −0.96687 | 1.63888 | 2.40071 |
| 4 | −0.69986 | 1.48188 | 1.32435 |
| 5 | −0.39029 | 1.18898 | 1.43038 |
| 6 | −0.25643 | 0.97728 | 9.65078 |
| 7 | 0.02210 | 0.38932 | −10.58069 |
| 8 | 0.11746 | 0.17564 | −278.57422 |
| 9 | 0.62121 | −0.91422 | 0. |
| 10 | 1.43249 | −2.66239 | 0.02251 |
| 11 | 1.39373 | −2.68491 | 0. |
| 12 | 1.11048 | −2.28610 | 1.50000 |
| 13 | 0.99750 | −2.09968 | 0. |
| 14 | −0.00415 | −0.13812 | −7.90200 |
| 15 | −0.62243 | 0.84541 | −4.28238 |
| 16 | −1.15904 | 1.44626 | 0.49943 |
| 17 | −1.24098 | 1.54462 | 0. |

CHART NO. 24
RADIAL DISTANCE FROM DATUM 43.038
(Build-up Section)

| POINT NO. | X | Y | R |
|---|---|---|---|
| 1 | −1.32947 | 1.33660 | 0.09038 |
| 2 | −1.27209 | 1.49469 | 0.81656 |
| 3 | −1.23680 | 1.49488 | 0.81656 |
| 4 | −1.07928 | 1.47691 | 1.75576 |
| 5 | −0.75510 | 1.37384 | 1.38580 |
| 6 | −0.57145 | 1.27833 | 1.13209 |
| 7 | −0.24507 | 0.97225 | 2.27011 |
| 8 | −0.09409 | 0.72900 | 6.71017 |

-continued

CHART NO. 24
RADIAL DISTANCE FROM DATUM 43.038
(Build-up Section)

| POINT NO. | X | Y | R |
|---|---|---|---|
| 9 | 0.10134 | 0.33408 | 0. |
| 10 | 0.32890 | −0.16645 | −18.82383 |
| 11 | 0.43821 | −0.40253 | 0. |
| 12 | 1.50818 | −2.67224 | 0.02161 |
| 13 | 1.47107 | −2.69405 | 0. |
| 14 | 1.22769 | −2.35453 | 1.80256 |
| 15 | 1.11543 | −2.17691 | 2.76371 |
| 16 | 1.08209 | −2.11478 | −92.35720 |
| 17 | 0.19771 | −0.45656 | −55.38329 |
| 18 | 0.11877 | −0.31261 | −8.21993 |
| 19 | −0.14766 | 0.13706 | −4.95991 |
| 20 | −0.36396 | 0.44984 | −3.22810 |
| 21 | −0.89504 | 1.00556 | −5.13317 |
| 22 | −1.23415 | 1.26191 | 1.03213 |
| 23 | −1.30258 | 1.31366 | 1.03213 |
| 24 | −1.32947 | 1.33660 | 0.0 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket for a steam turbine having a profile in accordance with Charts 2–12, 14–22 and 24, inclusive, as set forth in the specification.

2. A plurality of buckets constructed in accordance with claim 1 spaced circumferentially about an axis of a turbine wheel and having tips, and means for continuously coupling said tips one to the other about said axis.

3. The buckets according to claim 2 wherein said coupling means includes inner and outer covers for each bucket, said inner and outer covers alternately coupling adjacent pairs of buckets.

4. A plurality of buckets according to claim 3 including a sealing rib projecting radially from each of said outer covers forming an annular sealing ring about the tips of the buckets.

5. A bucket according to claim 2 wherein said coupling means between the adjacent tips of the buckets is loose, enabling relative movement between adjacent buckets.

6. A bucket according to claim 2 including means along intermediate lengths of the buckets for loosely coupling adjacent buckets one to the other.

7. A bucket according to claim 1 having a theoretical aerodynamic profile in accordance with Charts 1, 13 and 23.

8. A bucket according to claim 1 wherein said coupling means includes inner and outer covers for each bucket, said inner and outer covers alternately coupling adjacent pairs of buckets, each said outer cover being rigidly secured to an adjacent pair of buckets with sets of adjacent pairs of buckets arranged seriatim about a turbine wheel, said inner covers being loosely connected to adjacent buckets of adjacent pairs of buckets.

9. In a steam turbine having a turbine wheel and buckets each according to claim 1, 130 of said buckets arranged about said turbine wheel.

* * * * *